US007114242B2

(12) United States Patent
Berg et al.

(10) Patent No.: US 7,114,242 B2
(45) Date of Patent: Oct. 3, 2006

(54) LAYERED WING COIL FOR AN ELECTROMAGNETIC DENT REMOVER

(75) Inventors: Frederic P. Berg, Seattle, WA (US); David B. Smith, Renton, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/381,956

(22) Filed: May 5, 2006

(65) Prior Publication Data

US 2006/0191126 A1 Aug. 31, 2006

Related U.S. Application Data

(62) Division of application No. 11/192,783, filed on Jul. 29, 2005, which is a division of application No. 10/377,487, filed on Feb. 28, 2003, now Pat. No. 6,954,127.

(51) Int. Cl.
*H01F 3/00* (2006.01)
*H01F 41/06* (2006.01)

(52) U.S. Cl. ..... 29/605; 335/299

(58) Field of Classification Search ..... 336/222–225, 336/227, 232; 335/299; 72/54, 56, 57, 705; 29/602.1, 605
See application file for complete search history.

(56) References Cited

U.S. PATENT DOCUMENTS

| | | | | |
|---|---|---|---|---|
| 4,061,007 | A | 12/1977 | Hansen et al. | |
| 4,116,031 | A | 9/1978 | Hansen et al. | |
| 4,127,933 | A | 12/1978 | Hansen et al. | |
| 6,269,531 | B1 * | 8/2001 | Mercado et al. | 29/602.1 |
| 6,445,272 | B1 * | 9/2002 | Mercado et al. | 336/225 |

* cited by examiner

*Primary Examiner*—Ramon M. Barrera
(74) *Attorney, Agent, or Firm*—Lee & Hayes, PLLC

(57) ABSTRACT

Methods of fabricating electromagnet assemblies are disclosed. In one embodiment, a includes forming a first helix and a second helix, each helix having a first end and a second end and a substantially oval cross-section, the cross-section having a major axis, each helix being configured to concentrate electromagnetic flux at a midpoint on the major axis. Each helix is bent at an angle and offset from the major axis, resulting in a first planar surface including the major axis and a second planar surface. The first and second helixes are oriented such that the outer edges of the respective second planar surfaces coincide and the outer edges of the respective first planar surfaces are in diametric opposition. The first and second helixes are affixed by their respective second planar surfaces, and electrically connected by their respective second ends.

18 Claims, 10 Drawing Sheets

LAYERED WING COIL FOR AN ELECTROMAGNETIC DENT REMOVER

CROSS REFERENCE TO RELATED APPLICATIONS

This patent application is a divisional application of co-pending, commonly-owned U.S. patent application Ser. No. 11/192,783 entitled "Layered Wing Coil for an Electromagnetic Dent Remover" filed on Jul. 29, 2005, which is a divisional application of commonly-owned U.S. patent application Ser. No. 10/377,487 entitled "Layered Wing Coil for an Electromagnetic Dent Remover" filed on Feb. 28, 2003, issued as U.S. Pat. No. 6,954,127 on Oct. 11, 2005, which applications and issued patent are incorporated herein by reference.

FIELD OF THE INVENTION

This invention relates generally to electromagnetism and, more specifically, to electromagnets.

BACKGROUND OF THE INVENTION

Dents may occur in metal surfaces, and removal of the dents may be desirable for aesthetic or performance reasons. For example, airplane wings may become dented during operational service. Dents in airplane wings may decrease lift and may increase drag. As a result, it would be desirable to remove dents from airplane wings.

It is currently known to remove dents in metal surfaces by "pulling" the dents in the surface of the metal with a magnetic field generated by a coil of an electromagnet. Examples of known coils are disclosed in U.S. Pat. Nos. 4,061,007 and 4,123,933, the contents of which are hereby incorporated by reference.

Referring to FIG. 1, a prior art electromagnetic coil 10 includes an annular wrap of layers 12 of a conductor 14. These coils are visible through the head 13 of the coil 10. The coil 10 defines notches in the annular wrap that serve as foot 18. The foot 18 and is the locus on the electromagnetic coil 10 used for pulling dents.

However, present coils have presented some shortcomings. For example, known coils are expensive to fabricate and have reached their maximum power level. Further, current coils are subject to a high failure rate. Current coils may fail if the coil moves excessively in its housing while the coil is energized to pull a dent. Further, dielectric material within the coil may become damaged from high heat and stresses generated during the firing process. Also, current coils may experience reduced performance. For example, current coils may generate excessive amounts of heat and may generate a reduced magnetic field due to mechanical property changes at elevated temperatures.

Referring now to FIG. 2, a failure 20 of the prior art electromagnetic coil 10 is illustrated. The annular wrap of the layers 12 of the conductor 14 is a principal feature allowing susceptibility to the failure 20. The failure 20 occurs when an applied electromagnetic force pulls one of the layers 12 of the conductor 20 from the electromagnetic coil 10.

Therefore, there is an unmet need in the art for a coil for an electromagnetic dent remover that is less expensive to fabricate and has a lower failure rate than currently known coils, and has increased performance over currently known coils.

SUMMARY OF THE INVENTION

The present invention provides an electromagnet assembly for supplying a region of concentrated electromagnetic flux, and methods of fabricating such assemblies. In one embodiment, a method for making an electromagnetic coil assembly includes forming a first helix and a second helix, each helix having a first end and a second end and a substantially oval cross-section, the cross-section having a major axis, each helix being configured to concentrate electromagnetic flux at a midpoint on the major axis. Each helix is bent at an angle along a line in the plane of the cross-section parallel to and offset from the major axis resulting in a first planar surface including the major axis and a second planar surface, each planar surface having an outer edge opposite the offset line. The first and second helixes are oriented such that the outer edges of the respective second planar surfaces coincide and the outer edges of the respective first planar surfaces are in diametric opposition. The first and second helixes are affixed by their respective second planar surfaces, and electrically connected by their respective second ends.

BRIEF DESCRIPTION OF THE DRAWINGS

Embodiments of the present invention are described in detail below with reference to the following drawings.

DETAILED DESCRIPTION

By way of overview, an electromagnet assembly for supplying a region of concentrated electromagnetic flux is provided. The assembly includes a flat strip of an electrically conductive metal. The strip has a first and a second opposite planar surfaces at least one of which is covered by a dielectric material. The strip has first and second end portions. The strip is wound in a coil including at least one first loop and one second loop and disposing the second opposite planar surface in the first loop substantially adjacent the first opposite planar surface in the second loop. The coil is disposed about an axis of symmetry configured to concentrate electromagnetic flux at a midpoint on the axis of symmetry. First and second electrical terminals are connected at the first and second end portions, respectively.

Figure 1:
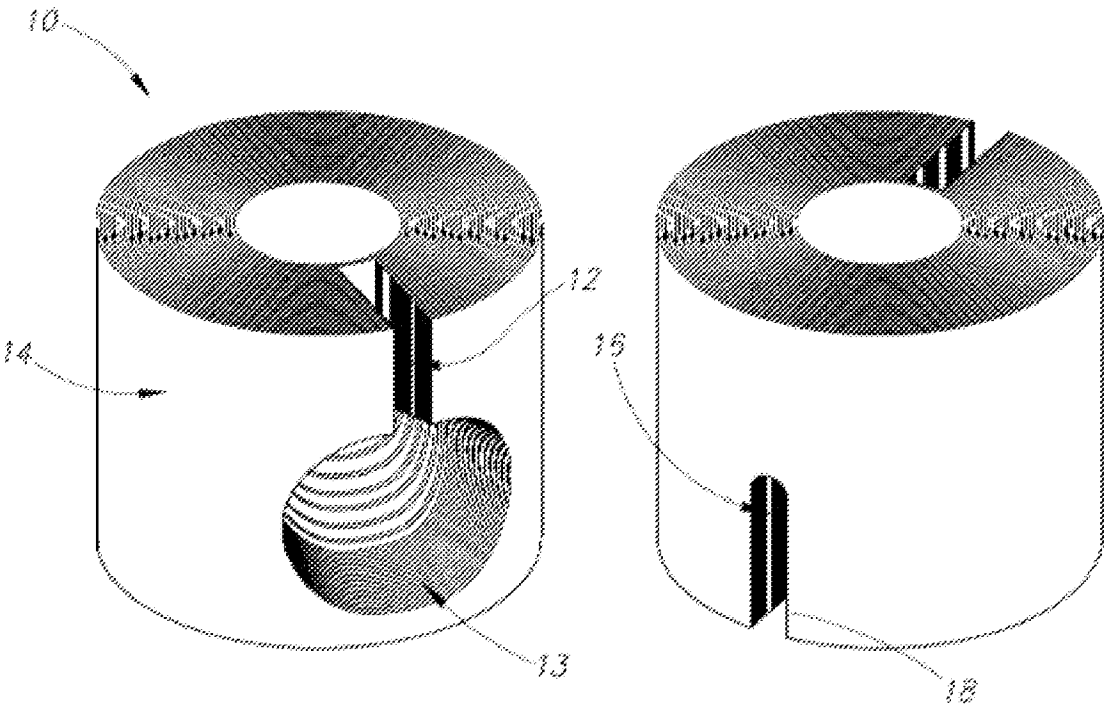
Fig. 1 (Prior Art)
FIG. 1 is a perspective view of the prior art electromagnetic coil.
Figure 2:
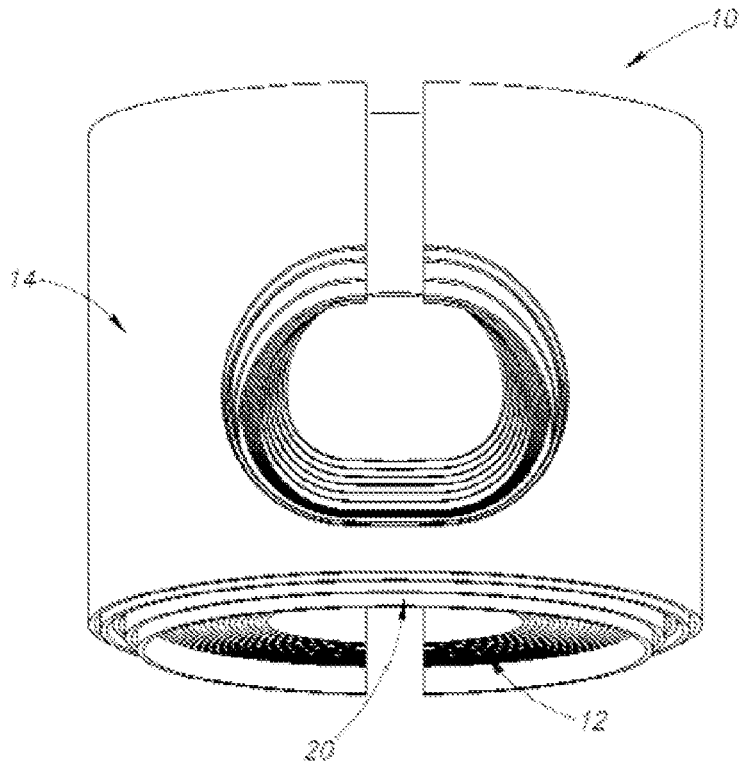
Fig. 2 (Prior Art)
FIG. 2 is a perspective view of the failure of the prior art electromagnetic coil.
Figure 3:
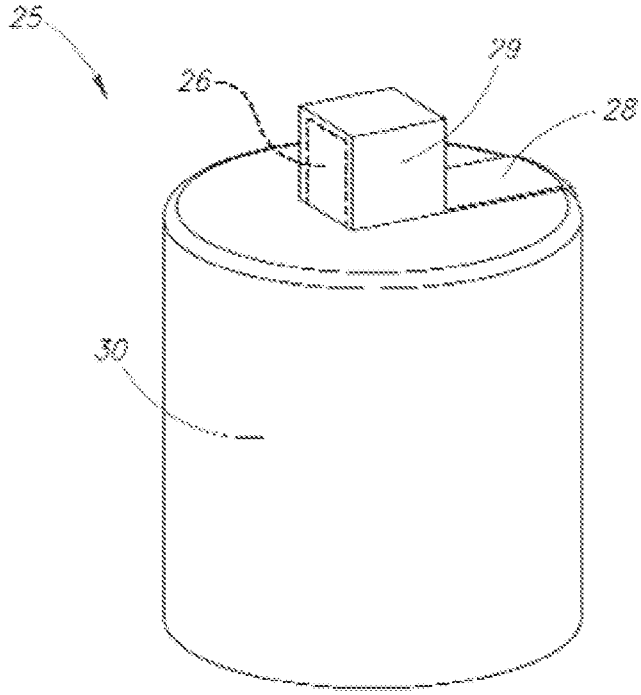
FIG. 3 is an upper perspective view of the encased layered wing coil.

Referring now to FIG. 3, a layered wing coil assembly 25 according to an embodiment of the invention includes a fastening point 29 and an encasement 30. The fastening point 29 provides a suitable holding spot when the assembly 25 is energized. Advantageously, the fastening point 29 allows the assembly 25 to be used in a working head (not shown) of currently known electromagnetic dent removers. Two conductors 26 and 28 extend from the fastening point 29 through the encasement 30. The encasement 30 provides electromechanical integrity to the whole of the packaged assembly 25.

Figure 4:
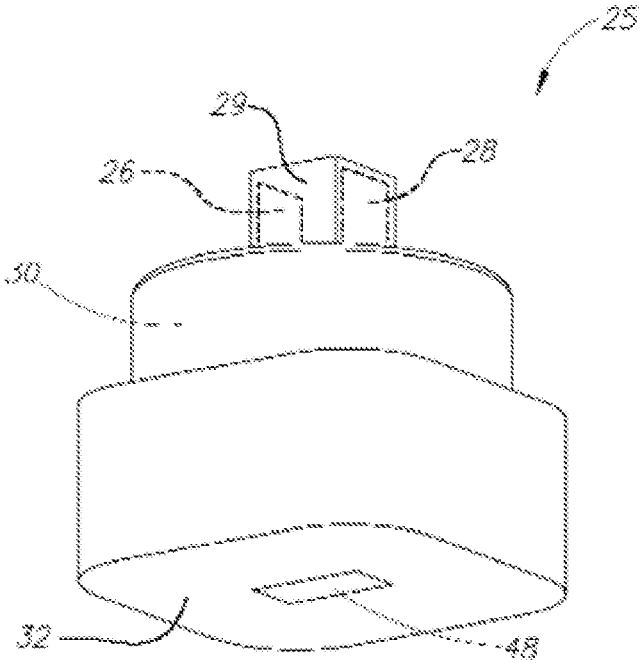
FIG. 4 is a lower perspective view of the encased layered wing coil.

Referring now to FIG. 4, a lower surface 32 of the encasement 30 defines a foot portal 34 that exposes a coil's keel 48 at its point of concentrated flux. Advantageously, the lower surface 32 of the encasement is the mechanical support for the assembly 25 allowing the lifting of the assembly 25 from a dented surface and for maintaining alignment between the assembly 25 and the dented surface (not shown). The features evident in FIG. 3 are present here as well. The fastening point 29, the conductors 26, 28, and the encasement 30 each are visible.

Figure 5:
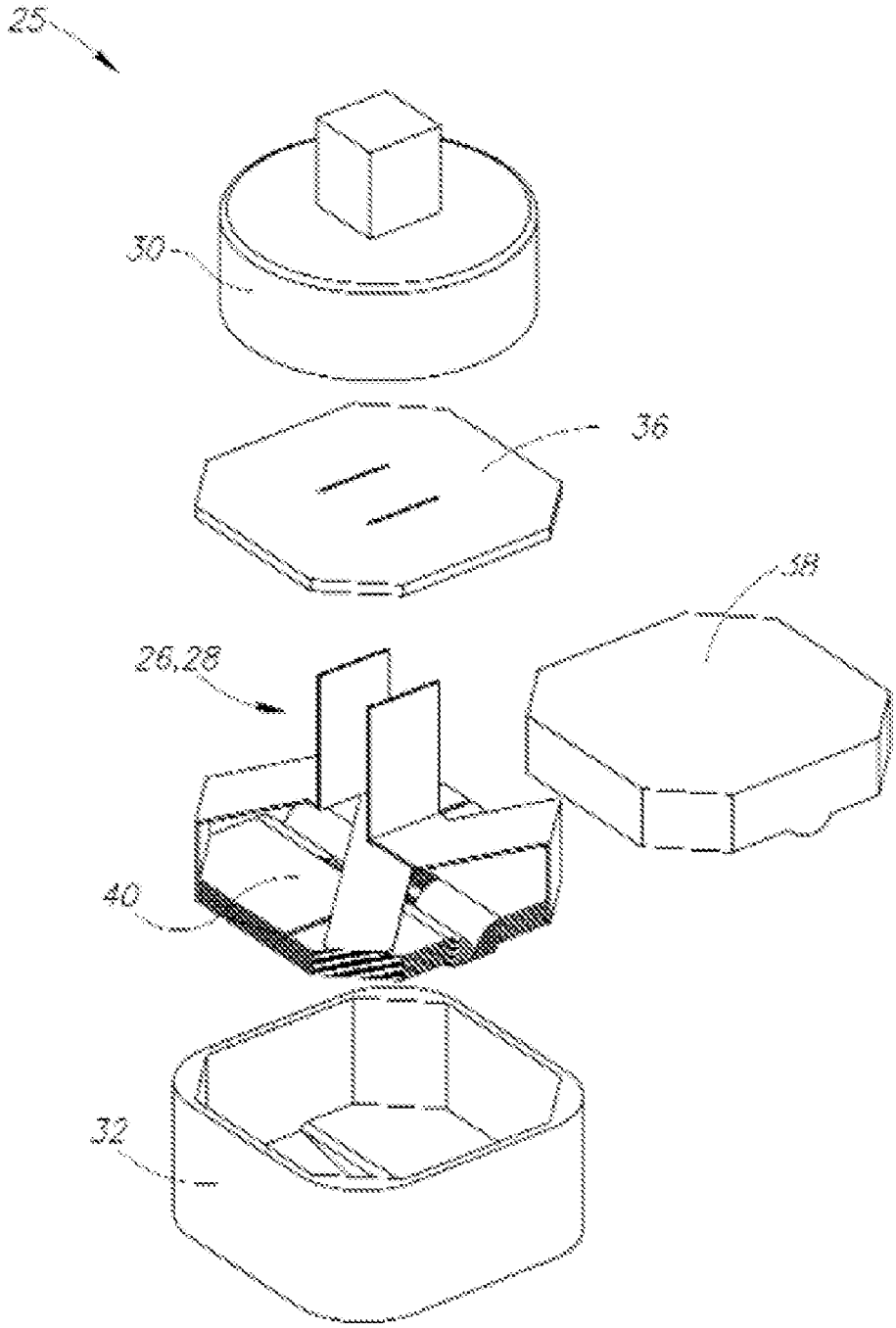
FIG. 5 is an exploded perspective view of the components of the layered wing coil.

FIG. 5 is an exploded perspective view of components of the layered wing coil assembly 25. In the presently preferred embodiment, the components fixedly position and encase a layered wing coil 40. The encasement 30 and its lower surface 32 form an outer shell. Within the shell, a spacer 36 receives and holds separate the two conductors 26 and 28. The conductors 26 and 28 pass to either side of a stabilizing mount 38 to feed current to the layered wing coil 40.

Figure 6:
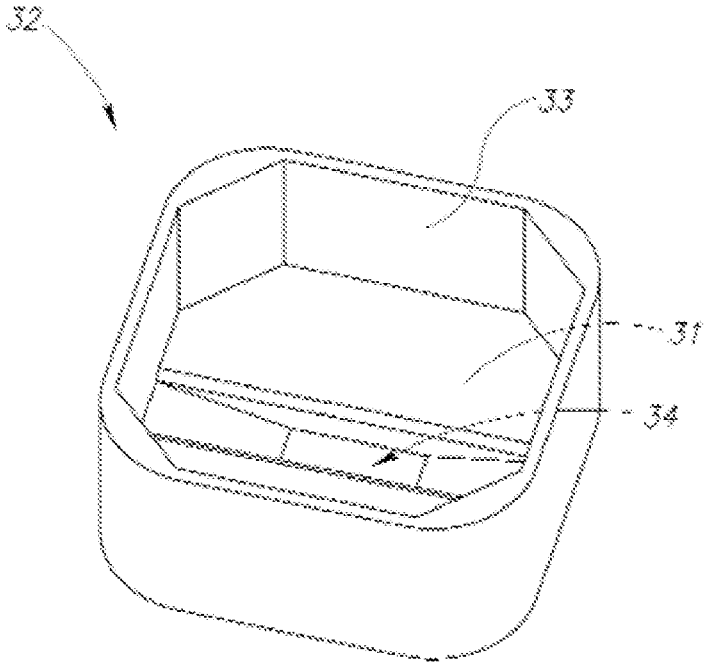
FIG. 6 is the support for the layered wing coil.

Referring now to FIG. 6, shelf support 31 for the layered wing coil (not shown) is molded into the inner surface of the lower case 32. The foot portal 34 defined by the lower case 32 also maintains the appropriate alignment between the workpiece (not shown) and the layered wing coil 40. Additionally, the walls 33 of the lower case 32 in connection with the upper encasement (not shown) provide the mechanical integrity of the electromagnetic coil (not shown).

Figure 7:
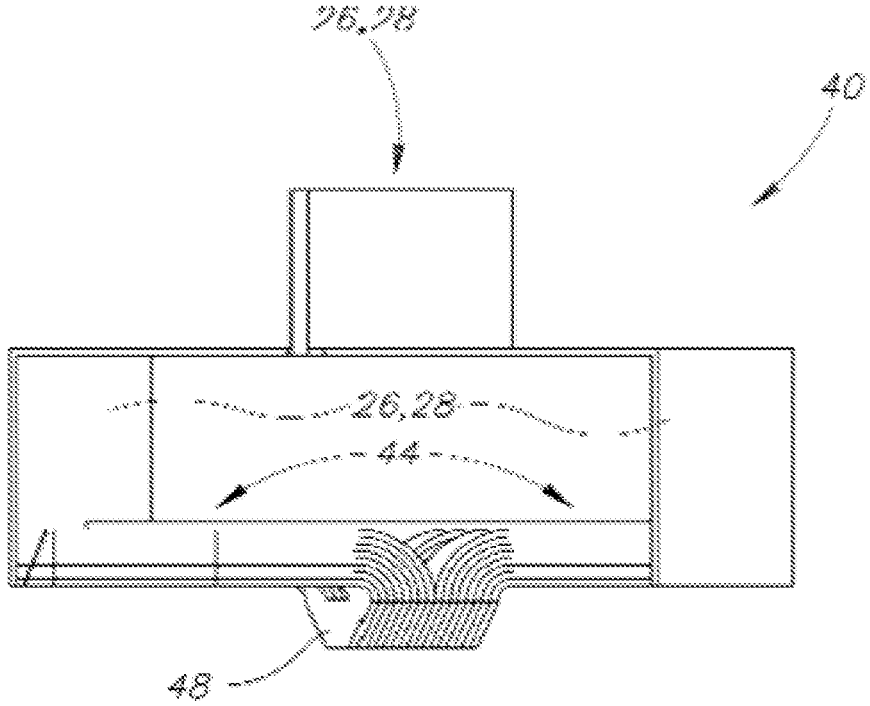
FIG. 7 is a cut-away diagram of the layered wing coil along the major axis of symmetry.

FIG. 7 is a cut-away diagram of the layered wing coil 40 along a major axis of symmetry. The conductors 26 and 28 extend from the top of the encasement (not shown) to the bottom of the layered wing coil 40 where they provide a current path. Layers of conductive, substantially oval-shaped sheets 44 are stacked to either side of a midline. A jumper 46 completes the current path from the conductor 26 through the layers of the sheets 44 to the conductor 28. The sheets 44 are bent to form a keel 48 that concentrates the magnetic flux produced when current flows through the layered wing coil 40.

Figure 8:
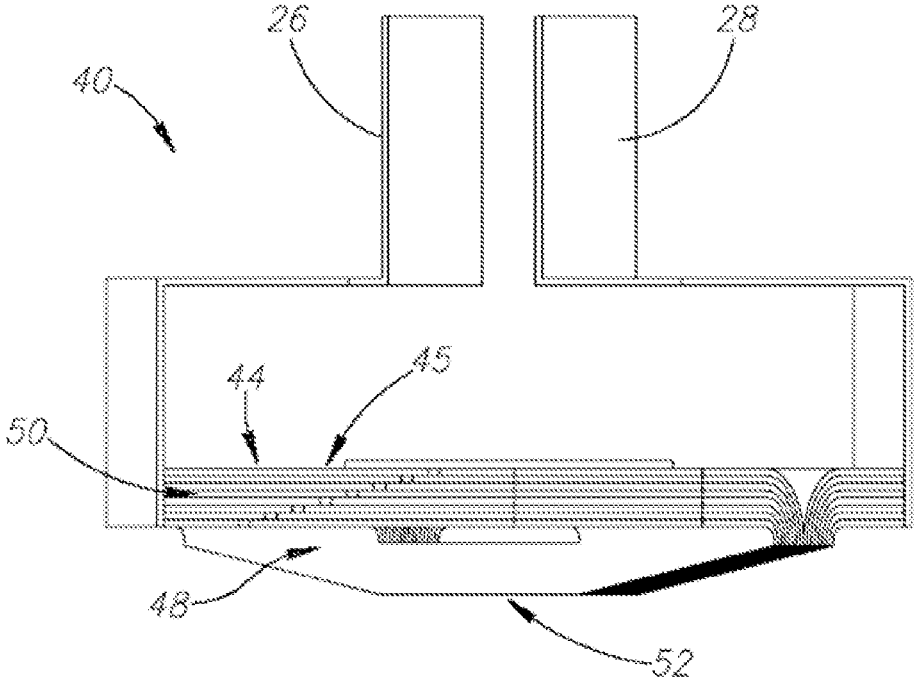
FIG. 8 is a cut-away diagram of the layered wing coil along the minor axis of symmetry.

FIG. 8 is a cut-away diagram of the layered wing coil 40 along a minor axis of symmetry. The conductors 26 and 28 conduct transient current to the lowest layer of the sheets 44. Interruptions 50 in each of the sheets 44, in concert with dielectric sheets 45 between conductive sheets 44, force the flow of current around each of the sheets 44 rather than through the height of the stack of sheets 44. A foot 52 is formed at the bottom of the keel 48. The magnetic flux is connected to the foot 52.

Figure 9:
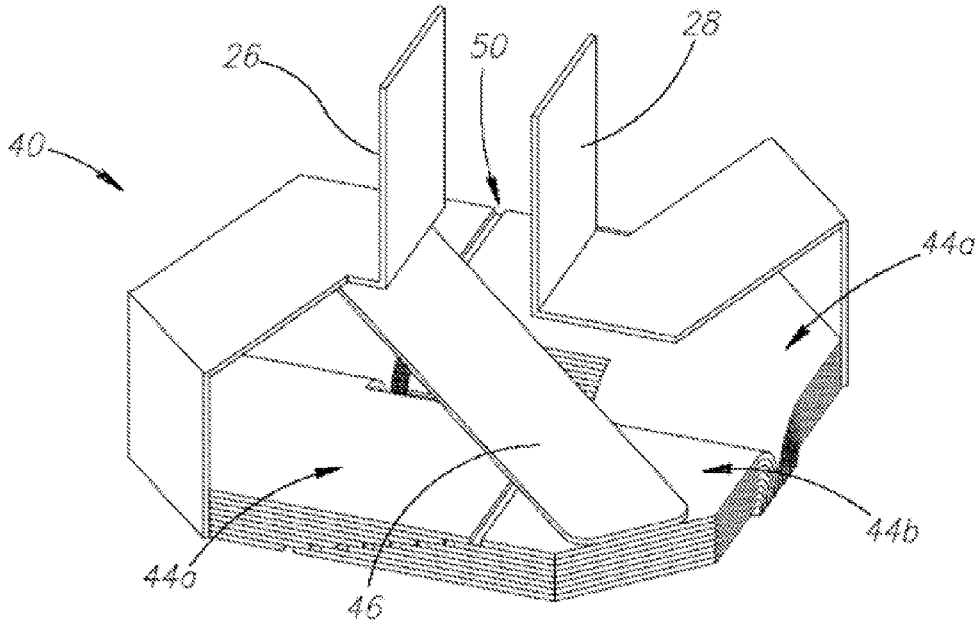
FIG. 9 is a perspective view of the layered wing coil.

Referring now to FIG. 9, the conductors 26 and 28 conduct current to the bottom of the sheets 44. The jumper 46 provides a conductive path between a second end 44*b* of one sheet 44 to a second end (not shown) of another sheet 44. First ends 44*a* of one sheet 44 are electrically joined to second ends of a sheet 44 directly beneath it to form substantially helical current paths (not shown). This maintains the current flow direction in foot 52.

Figure 10:
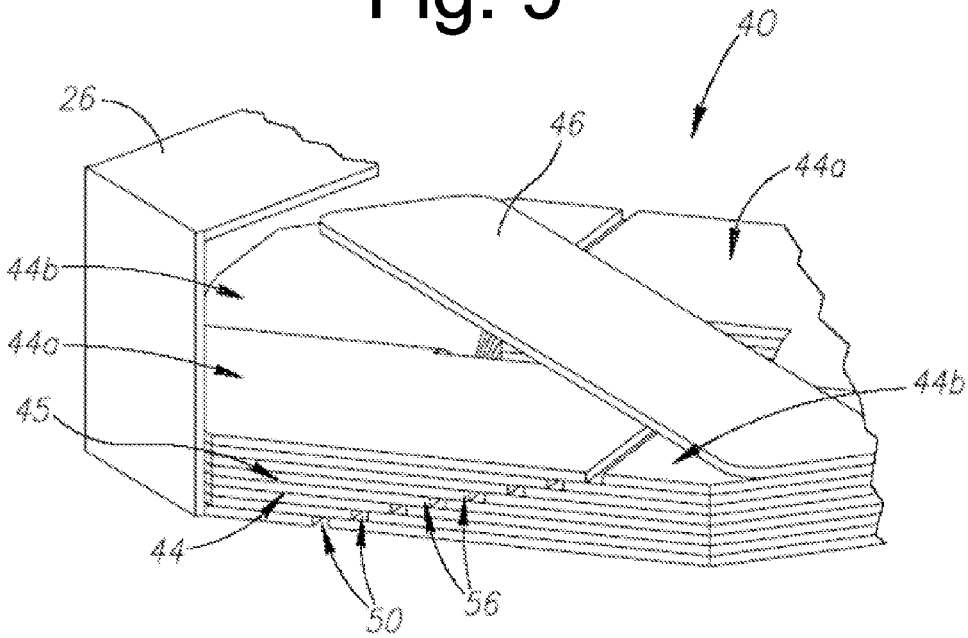
FIG. 10 is a close-up perspective view of the layered wing coil.

Referring now to FIG. 10, details are shown of the helical coil structure of the sheets 44. The jumper 46 carries current from the second end 44*b* of a top sheet 44. The interruptions 50 in each sheet 44 allow a current path around the sheet 44. Fusion points 56 join second ends of a first sheet 44*b* to first ends of a second sheet 44*a*. The resulting helical current path propagates a magnetic field when a transient current is applied.

Figure 11:
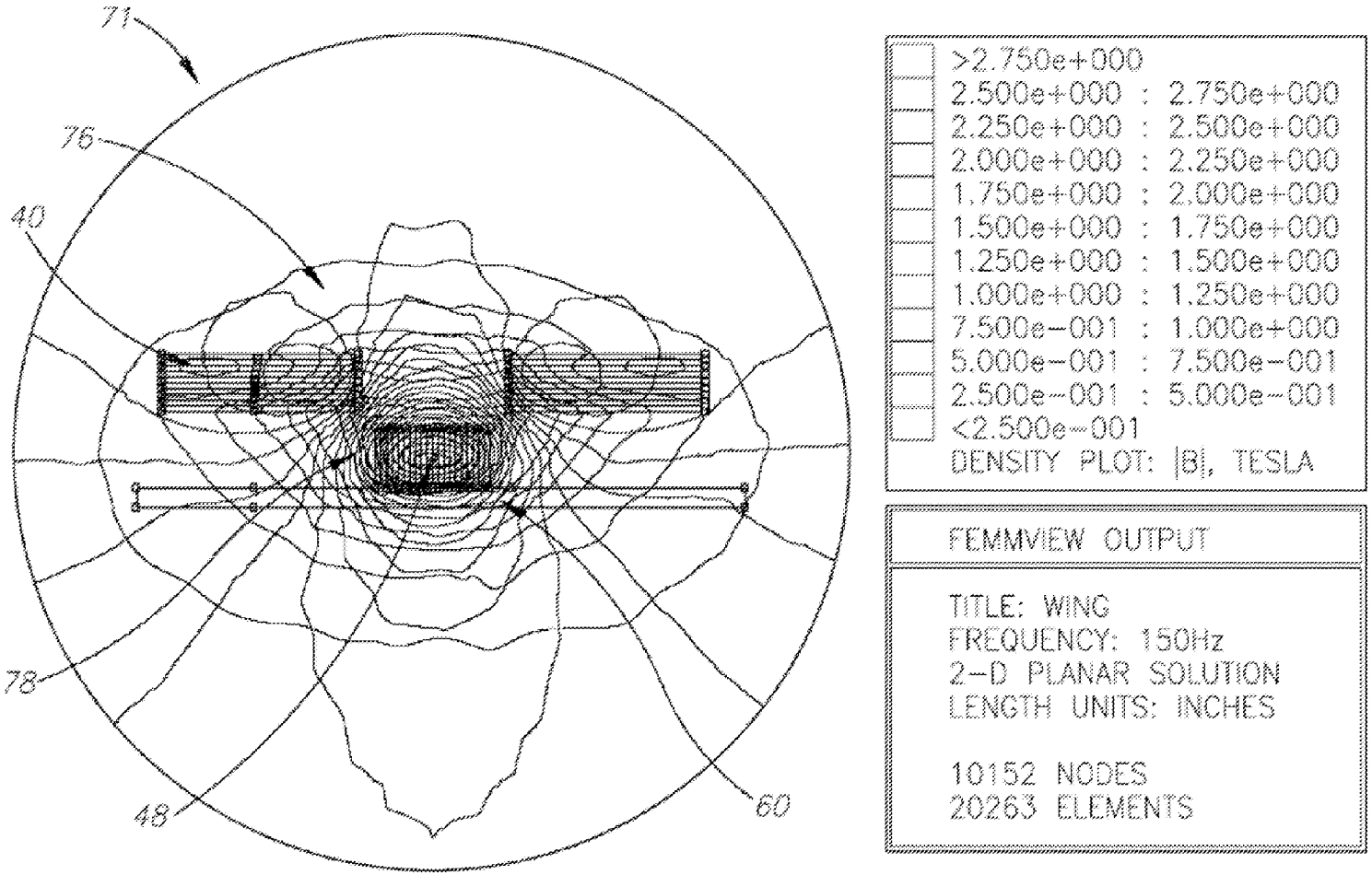
FIG. 11 is a flux diagram of the layered wing coil.

Referring now to FIG. 11, a diagram 71 shows flux generated by the layered wing coil 25. The Finite Element Method Magnetics® chart shows the sums of the flux contribution of each element in the layered wing coil 40 as isolines. An isoline is a line on a map or chart along which there is a constant value, in this case, magnetic flux. The flux concentrated at a workpiece surface 60 and flux concentrating features of the keel 48, and the layered wing coil 40 appear through an orthogonal slice through the coil assembly 25. The concentrations of isolines 76 and 78, for example, show the superior magnetic flux concentration at the workpiece surface 60 in the layered wing coil 40.

Figure 12:
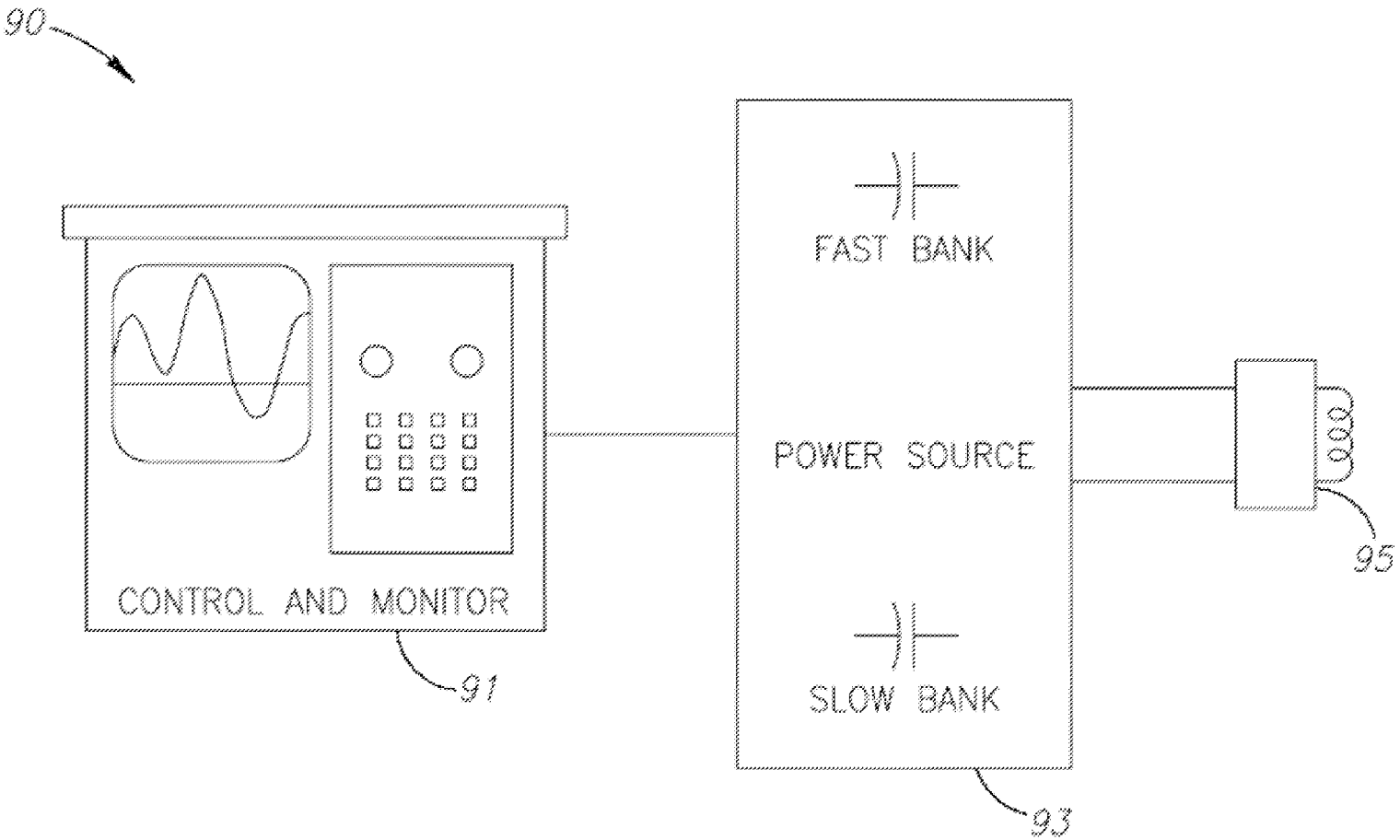
FIG. 12 is a block diagram of the principal components of the electronic dent puller.

Referring now to FIG. 12, a block diagram of the functional portions of an electronic dent remover 90 according to another embodiment of the invention is shown. The working coil 95 including the layered wing coil is connected to the power supply 93. As shown, the power supply 30 has both fast and slow capacitor banks to provide fast and slow rise current. A controller 91 is connected to and governs the power supply 93 to the working coil 95.

Figure 13:
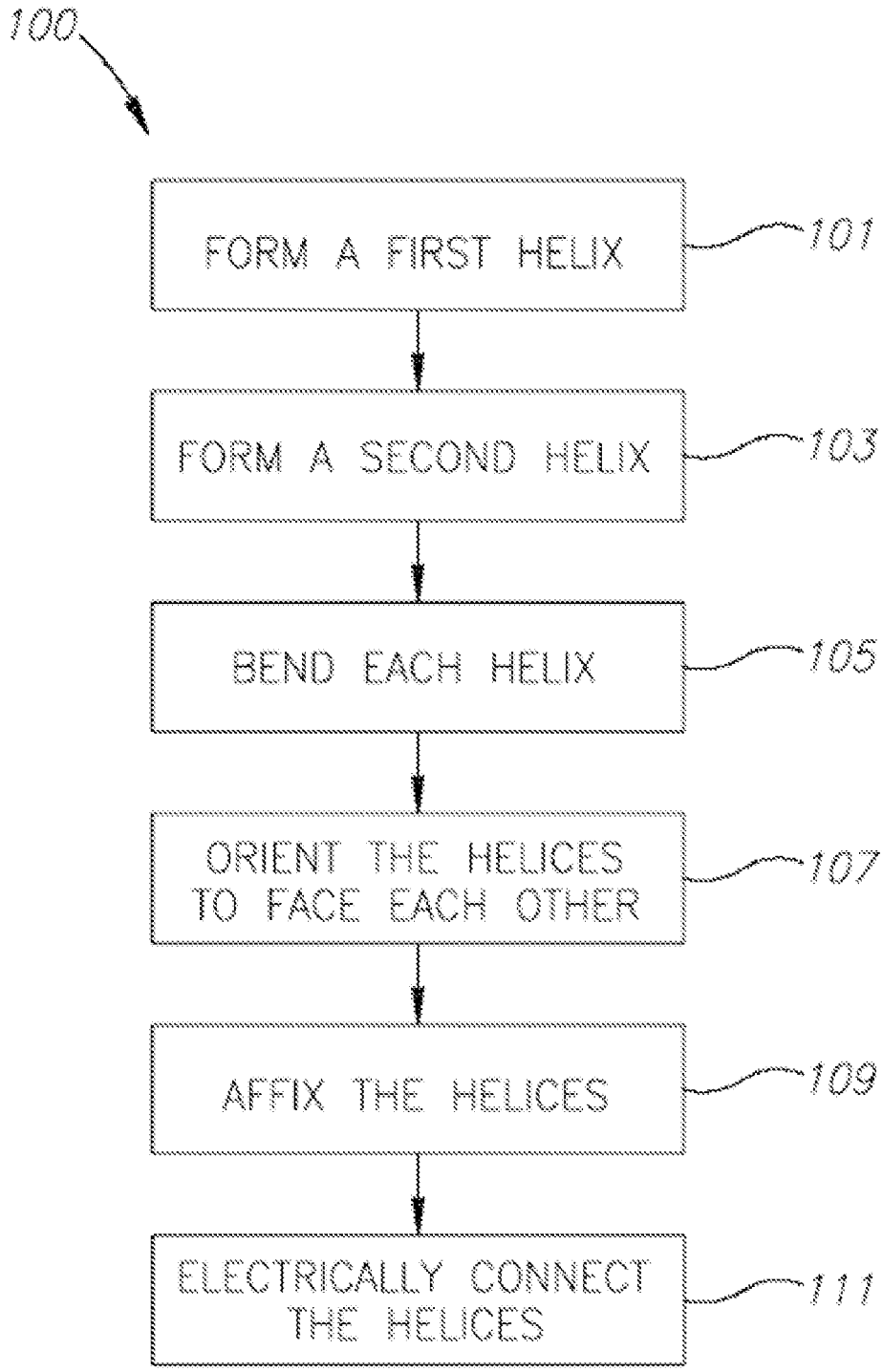
FIG. 13 is a flow chart of the formation of the layered wing coil.

Referring now to FIG. 13, a method 100 for forming the layered wing coil assembly 25 according to another embodiment of the invention is shown. The method 100 starts at a block 101. At the block 101, forming the first helix occurs; at a block 103, forming the second helix occurs. These helices are formed of a flat strip of conductive metal coiled and interleaved with an insulating coating. In the presently preferred embodiment, the coils are roughly oval in section.

At a block 105, each of the helices is bent along a line parallel and offset from the major axis. The resulting helix has an "L"-shaped (appearing) profile. The major axis remains in the unbent section of coil. At a block 107, the second helix is oriented towards the first helix such that each shorter leg of each "L" is placed in contact with the other. The resulting joined helices appear to be a mirror image one of the other. In toto, the bent helices give an impression of an opened book bound with the coils of the helix as pages. At a block 109, the helices are electrically joined for electromagnetic effect. As a result, the magnetic coil has its most efficient concentration of flux.

Figure 14:
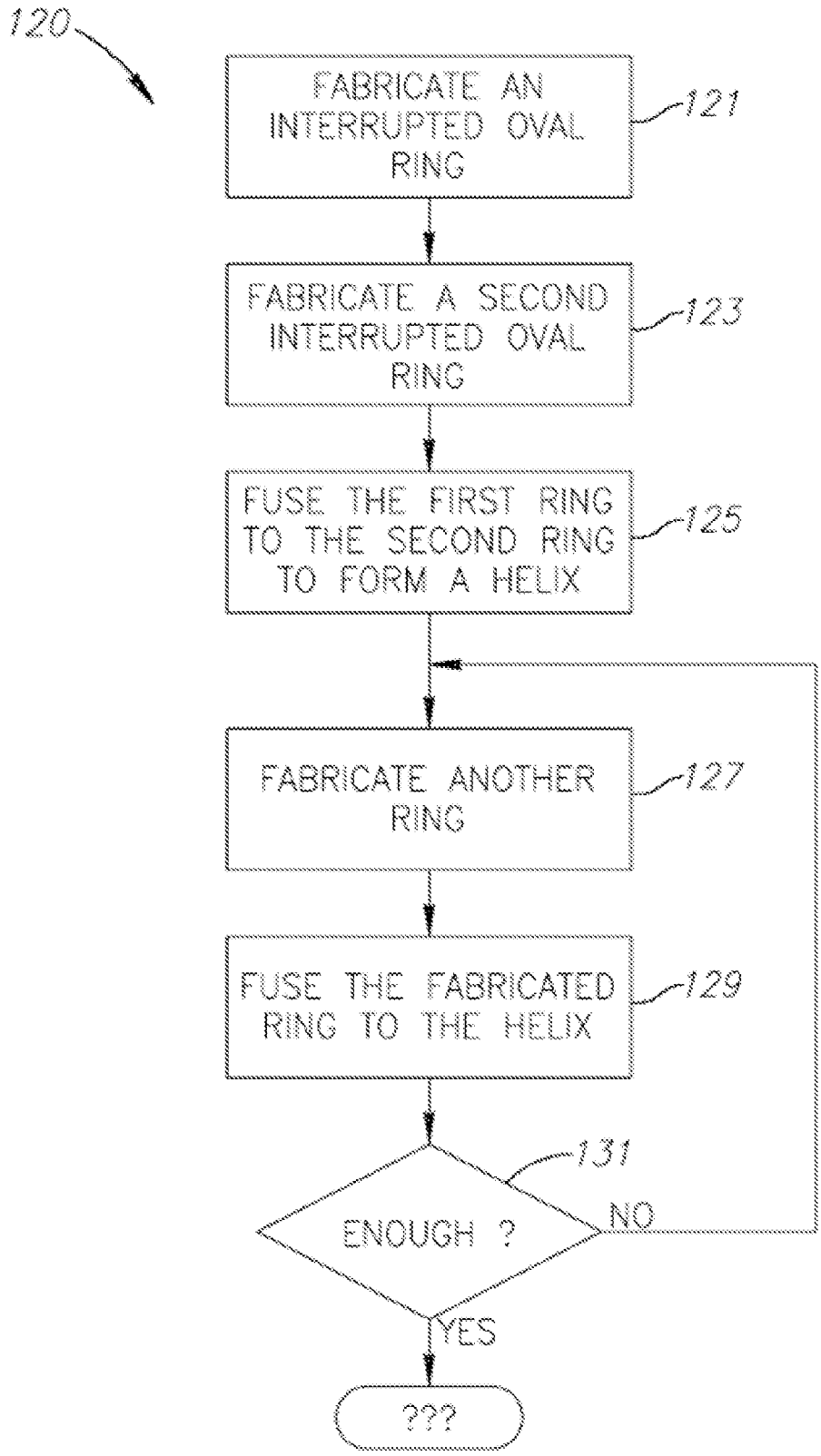
FIG. 14 is a flow chart of the formation of the component helices of the layered wing coil.

Referring now to FIG. 14, a non-limiting presently preferred method 120 for forming the component helices of the layered wing coil 40 starts at a block 121. At the block 121, fabricate an interrupted substantially oval-shaped ring. Such rings can be easily milled and stamped from copper sheeting. At a block 123, a second ring can be easily fabricated with an identical profile to the first ring but interrupted at a place slightly displaced from the location of the first interruption. At a block 125, the first ring is fused to the second ring at the slight overlap. As a result of the fusion, a two-turn helix is manufactured.

Where another ring is necessary, it is fabricated at a block 127. Like the second ring, the interruption of the oval is offset slightly from that in the second ring. At a block 129, it is fused to the helix to extend it by another coil. At a block 131, the length of the resulting coil is compared to the desired coil length. If the coil length is long enough, the method terminates, otherwise, the method returns to the block 127 to fabricate another ring.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A method for making an electromagnetic coil assembly, comprising:

forming a first helix and a second helix, each helix having a first end and a second end and a substantially oval cross-section, the cross-section having a major axis;

bending each helix at an angle along a line in the plane of the cross-section parallel to and offset from the major axis resulting in a first planar surface including the major axis and a second planar surface, each planar surface having an outer edge opposite the offset line;

orienting the first and second helixes such that the outer edges of the respective second planar surfaces coincide and the outer edges of the respective first planar surfaces are in diametric opposition;

affixing the first helix to the second helix by their respective second planar surfaces; and connecting electrically the second end of the first helix to the second end of the second helix.

2. The method of claim 1, wherein forming includes winding a substantially flat strip of an electrically conductive material about an axis of symmetry that is approximately perpendicular to the surfaces and extending through a keel portion configured to concentrate electromagnetic flux at a midpoint on the axis of symmetry.

3. The method of claim 1, wherein forming includes:

fabricating at least one first ring and at least one second ring, the first and second rings being interrupted, substantially oval shaped rings, the rings being formed from a substantially flat strip of an electrically conductive metal, the strip having opposite planar surfaces at least one of which is covered by a dielectric material, the strip having first and second end portions, the interruption in each first ring being offset from the interruption of each second ring;

fusing the second end portion of each first ring to the first end portion of each second ring; and stacking the fused rings into a first helix and a second helix, each helix having a same handedness.

4. The method of claim 1, wherein the method further includes:

providing a supporting wafer for the helixes, the supporting wafer defining a portal exposing a portion of the outer edge of the respective second planar surfaces.

5. The method of claim 4, wherein providing a supporting wafer includes attaching the supporting wafer to a case enclosing the helixes.

6. The method of claim 4, wherein providing a supporting wafer includes providing a supporting wafer that is coextensive with the first planar surface of at least one of the first and second helixes.

7. A method for making an electromagnetic coil assembly, comprising:

forming a first helix and a second helix, each helix having a first end and a second end and a substantially oval cross-section, the cross-section having a major axis, each helix being configured to concentrate electromagnetic flux at a midpoint on the major axis;

bending each helix at an angle along a line in the plane of the cross-section parallel to and offset from the major axis resulting in a first planar surface including the major axis and a second planar surface, each planar surface having an outer edge opposite the offset line;

orienting the first and second helixes such that the outer edges of the respective second planar surfaces coincide and the outer edges of the respective first planar surfaces are in diametric opposition;

affixing the first helix to the second helix by their respective second planar surfaces; and connecting electrically the second end of the first helix to the second end of the second helix.

8. The method of claim 7, wherein forming includes winding a substantially flat strip of an electrically conductive material about the major axis.

9. The method of claim 7, wherein forming includes:

fabricating at least one first ring and at least one second ring, the first and second rings being interrupted, substantially oval shaped rings, the rings being formed from a substantially flat strip of an electrically conductive metal, the strip having opposite planar surfaces at least one of which is covered by a dielectric material, the strip having first and second end portions, the interruption in each first ring being offset from the interruption of each second ring;

fusing the second end portion of each first ring to the first end portion of each second ring; and stacking the fused rings into a first helix and a second helix, each helix having a same handedness.

10. The method of claim 7, wherein the method further includes:

providing a supporting wafer for the helixes, the supporting wafer defining a portal exposing a portion of the outer edge of the respective second planar surfaces.

11. The method of claim 10, wherein providing a supporting wafer includes attaching the supporting wafer to a case enclosing the helixes.

12. The method of claim 10, wherein providing a supporting wafer includes providing a supporting wafer that is coextensive with the first planar surface of at least one of the first and second helixes.

13. A method of fabricating an electromagnetic coil assembly, comprising:

forming first and second helixes, each helix having a first end and a second end and a cross-section having a major axis, and being angled along a line in the plane of the cross-section parallel to and offset from the major axis resulting in a first planar surface including the major axis and a second planar surface, each planar surface having an outer edge opposite the offset line;

orienting the first and second helixes such that the outer edges of the respective second planar surfaces coincide and the outer edges of the respective first planar surfaces are in diametric opposition;

affixing the first helix to the second helix by their respective second planar surfaces; and connecting electrically the second end of the first helix to the second end of the second helix, wherein the first and second helixes are configured to concentrate electromagnetic flux at a midpoint on the major axis.

14. The method of claim 13, wherein forming includes winding a substantially flat strip of an electrically conductive material about the major axis.

15. The method of claim 13, wherein forming includes:

fabricating at least one first ring and at least one second ring, the first and second rings being interrupted, substantially oval shaped rings, the rings being formed from a substantially flat strip of an electrically conductive metal, the strip having opposite planar surfaces at least one of which is covered by a dielectric material, the strip having first and second end portions, the interruption in each first ring being offset from the interruption of each second ring;

fusing the second end portion of each first ring to the first end portion of each second ring; and stacking the fused rings into a first helix and a second helix, each helix having a same handedness.

16. The method of claim 13, wherein the method further includes:

providing a supporting wafer for the helixes, the supporting wafer defining a portal exposing a portion of the outer edge of the respective second planar surfaces.

17. The method of claim 16, wherein providing a supporting wafer includes attaching the supporting wafer to a case enclosing the helixes.

18. The method of claim 16, wherein providing a supporting wafer includes providing a supporting wafer that is coextensive with the first planar surface of at least one of the first and second helixes.

* * * * *